US011305904B2

(12) United States Patent
Gallaun et al.

(10) Patent No.: US 11,305,904 B2
(45) Date of Patent: Apr. 19, 2022

(54) DEVICE AND METHOD FOR TRANSPORTING BAGS

(71) Applicant: Statec Binder GmbH, Gleisdorf (AT)

(72) Inventors: Heimo Gallaun, Gleisdorf (AT); Markus Wagner, St. Ruprecht/Raab (AT)

(73) Assignee: STATEC BINDER GMBH, Gleisdorf (AT)

( * ) Notice: Subject to any disclaimer, the term of this patent is extended or adjusted under 35 U.S.C. 154(b) by 78 days.

(21) Appl. No.: 15/871,316

(22) Filed: Jan. 15, 2018

(65) Prior Publication Data

US 2018/0215489 A1 Aug. 2, 2018

(30) Foreign Application Priority Data

Feb. 1, 2017 (EP) ..... 17154247

(51) Int. Cl.
*B65B 43/46* (2006.01)
*B65B 1/04* (2006.01)
(Continued)

(52) U.S. Cl.
CPC ..... *B65B 43/465* (2013.01); *B65B 1/04* (2013.01); *B65B 1/06* (2013.01); *B65B 1/22* (2013.01);
(Continued)

(58) Field of Classification Search
CPC ..... B65B 43/46; B65B 43/50; B65B 1/10; B65B 1/22; B65B 5/045; B65B 43/18; A22C 21/00
See application file for complete search history.

(56) References Cited

U.S. PATENT DOCUMENTS

2010/0192524 A1* 8/2010 Rapparini ..... B65B 31/024 53/512
2011/0232238 A1* 9/2011 May ..... A22C 21/00 53/473
(Continued)

FOREIGN PATENT DOCUMENTS

DE 203 09 914 9/2003
DE 10 2011 101 040 11/2012
(Continued)

OTHER PUBLICATIONS

India Search Report/Office Action conducted in counterpart India Appln. No. 201814001638 (dated Oct. 19, 2020) (includes English translation).

*Primary Examiner* — Anna K Kinsaul
*Assistant Examiner* — Daniel Jeremy Leeds
(74) *Attorney, Agent, or Firm* — Greenblum & Bernstein, P.L.C.

(57) ABSTRACT

A device for transporting and filling bags, preferably open bags, comprising a filling device, which is rotatable about an axis of rotation, having multiple filling openings distributed over the circumference of the filling device, and comprising a feeder, using which an empty bag can be fed to a filling opening, wherein the feeder comprises at least one holding unit for a bag, which is movable normally to the axis of rotation of the filling device, wherein the holding unit has two separate holders, wherein the holders are each movable forward and backward along the same open trajectory, wherein the first holder is mounted so it is movable on the filling device, while the second holder is mounted so it is movable on a spatially-fixed guide.

17 Claims, 13 Drawing Sheets

(51) Int. Cl.

| | |
|---|---|
| ***B65B 39/06*** | (2006.01) |
| ***B65B 1/22*** | (2006.01) |
| ***B65B 43/59*** | (2006.01) |
| ***B65B 61/28*** | (2006.01) |
| ***B65B 39/14*** | (2006.01) |
| ***B65B 39/10*** | (2006.01) |
| ***B65B 1/06*** | (2006.01) |
| ***B65B 43/16*** | (2006.01) |
| ***B65B 39/00*** | (2006.01) |
| ***B65B 43/60*** | (2006.01) |
| ***B65B 43/30*** | (2006.01) |
| ***B65B 1/32*** | (2006.01) |

(52) U.S. Cl.

CPC ..... *B65B 39/007* (2013.01); *B65B 39/06* (2013.01); *B65B 39/10* (2013.01); *B65B 39/145* (2013.01); *B65B 43/16* (2013.01); *B65B 43/30* (2013.01); *B65B 43/59* (2013.01); *B65B 43/60* (2013.01); *B65B 61/28* (2013.01); *B65B 1/32* (2013.01)

(56) References Cited

U.S. PATENT DOCUMENTS

| | | | | |
|---|---|---|---|---|
| 2014/0083559 | A1 | 3/2014 | Korte | |
| 2014/0102045 | A1* | 4/2014 | Yoshikane | B65B 43/465 53/459 |
| 2014/0331619 | A1 | 11/2014 | Takahashi | |
| 2017/0275032 | A1* | 9/2017 | Vollenkemper | B65B 39/12 |

FOREIGN PATENT DOCUMENTS

| | | |
|---|---|---|
| JP | 2008-94439 | 4/2006 |
| WO | 2013/013731 | 1/2013 |

* cited by examiner

DEVICE AND METHOD FOR TRANSPORTING BAGS

CROSS-REFERENCE TO RELATED APPLICATION

The present application claims priority under 35 U.S.C. § 119(a) of European Patent Application No. 17154247.5 filed Feb. 1, 2017, the disclosure of which is expressly incorporated by reference herein in its entirety.

FIELD OF THE INVENTION

The present invention relates to a device for transporting and filling bags, preferably open bags, comprising a filling device, which is rotatable about an axis of rotation, having multiple filling openings distributed over the circumference of the filling device, and also comprising a feeder, using which an empty bag can be fed to a filling opening, wherein the feeder comprises at least one holding unit for a bag which is movable normally to the axis of rotation of the filling device.

DISCUSSION OF BACKGROUND INFORMATION

Various devices for transporting and filling bags are known from the prior art. These devices are also used, inter alia, when filling open bags with bulk material. To increase the throughput, such devices are often embodied as rotatable, wherein fixing units, which are used for fastening the bags around the filling openings (for example, on a filling nozzle) or below the filling openings are arranged so they are rotatable about a rotating column. Empty bags are conveyed from the feeder to the filling device and accepted thereby. After the fastening of the bags to the filling openings by the fixing units, the bags are filled and transported further by rotation of the filling device, until they are removed from the filling device again by a bag removal unit (bag remover).

To avoid a cyclic operating mode of such devices, i.e., for example, stopping the filling device to feed a bag and/or to remove a bag, feeders are known which move in some sections with the filling device, so that the filling device can maintain a consistent rotational velocity.

Accelerating a transfer unit to a velocity which enables the transfer of the bags without the filling device having to be decelerated at the same time for the purpose of the transfer of the empty bags to the rotatable filling device is known from WO 2013/013731 A1. The transfer unit has for this purpose a gripping arm having a gripping unit as a holding unit, wherein the gripping arm is designed as revolving around the transfer unit, on the one hand, to move the gripping arm back into the starting position after transfer of a bag to the filling device, and the gripping arm executes a longitudinal movement, on the other hand, which is adapted at least temporarily to the circumferential velocity of the revolving movement of the filling nozzles, to transfer a bag to the continuously rotating filling device.

However, this device has the disadvantage that the guide of the gripping arm is complex and susceptible to wear due to the combination of revolving movement and longitudinal movement. Because of the tangential movement of the transfer unit—in relation to the rotational movement of the filling device—it also requires an increased amount of space at the production location.

SUMMARY

Embodiments of the present invention provide a simpler holding unit, by which the filling device can be operated continuously at constant velocity and additionally manages with less space required.

The starting point is a device for transporting and filling bags, preferably open bags, comprising a filling device, which is rotatable about an axis of rotation, having multiple filling openings distributed over the circumference of the filling device, and also comprising a feeder, using which an empty bag can be fed to a filling opening, wherein the feeder comprises at least one holding unit for a bag which is movable normally to the axis of rotation of the filling device. The term "normally to the axis of rotation" in this case can comprise in principle both a movement component radially to the axis of rotation and also a movement component in the circumferential direction.

Embodiments of the invention provide that the holding unit has two separate holders, wherein the holders are each movable forward and backward along the same open trajectory, wherein the first holder is mounted so it is movable on the filling device, while the second holder is mounted so it is movable on a spatially-fixed guide.

Due to the separation of the holding unit into two holders separate from one another, of which only the second has to be guided separately from (for example, outside) the filling device, less space is required for this second holder than for a holding unit which comprises both holders. At least two holders are necessary so that they can grasp an empty folded bag from two sides and open it.

Due to the separation of first and second holder, they are movable independently of one another and trajectories can be established more easily which do not collide with other parts of the filling device, for example, filling nozzles.

The first holder moves forward on a predefined trajectory to move the empty bag at the same velocity as the filling device with the filling device, until the bag is fastened on the filling device. The first holder then detaches from the bag and moves back on the same trajectory to accept the next empty bag. The second holder executes the same movement sequence, generally simultaneously with the first holder, thus moves forward on a predefined trajectory to move the empty bag at the same velocity as the filling device with the filling device, until the bag is fastened on the filling device. The second holder then detaches from the bag and moves back on the same trajectory, to accept the next empty bag. Since the guide of the first holder is provided on the filling device, no space radially outside the filling device is occupied by this guide in any case.

The trajectory which the respective holder follows is open, and can thus be, for example, a linear or curved route. This differs from closed trajectories from the prior art, where the holder or gripper does not change its movement direction, but rather circulates along a circular path or another closed curve, always in the same direction. Because forward and reverse movement of the respective container takes place along the same trajectory section according to the invention, space is saved in contrast to closed trajectories, because one trajectory section is required there for carrying along the empty bag and another trajectory section is required for returning the holder or gripper into the starting location, wherein the trajectory section for the return of the holder generally lies radially outside the trajectory section for carrying along the empty bag.

In one embodiment variant, first and second holder can be movable in parallel to one another. The trajectories thereof thus extend in parallel to one another, the holders and/or the guides thereof then always have the same spacing along the trajectories. However, it would also be conceivable that the trajectories (in the sense of the path predefined by the guides of the holders) of first and second holder move away from one another, for example, to assist the opening of the empty bag.

In one preferred embodiment, the first holder is mounted so it is movable inside the filling openings and the second holder is mounted so it is movable outside the filling openings. The empty bag can thus be opened most easily so that the bag opening is located below the filling opening. Due to the guide of the first holder inside the filling openings, a corresponding space saving results outside the filling openings, so that a possible housing of the device according to the invention can be constructed smaller.

The second holder is preferably located at least partially radially inside the largest diameter of the filling device. In this case, the second holder is always located in all of its possible positions at least partially radially inside the largest diameter of the filling device, and never completely outside. Space can thus be saved at the height of the second holder in the radial direction—in relation to the axis of rotation of the filling device—outside the filling device. The spatially-fixed guide of the second holder can be located radially outside the largest diameter of the filling device in this case. This space savings in the radial direction may be increased still further if the spatially-fixed guide of the second holder is also arranged radially inside the largest diameter of the filling device, and therefore the second holder is also completely arranged radially inside the largest diameter of the filling device.

A particularly simple trajectory, which is compatible with the rotational movement of the filling openings, results if the trajectory of the first and/or the second holder is one section of a circular path, i.e., a circular arc. The curvature of the section of the circular path is oriented outward in this case. In particular, it can be provided that the center point of the circular path lies on the axis of rotation of the filling device. The circular path of the trajectory of the first and/or the second holder is then concentric to the axis of rotation of the filling device.

The first and/or the second holder can each comprise a suctioning device, preferably because it only engages outside the empty bag. Therefore, first and second holder can engage from the outside on the empty bag, suction it, and open it. Engaging into the interior of the bag is not necessary.

It can be provided that the suctioning device of the first and/or the second holder is movable radially in relation to the rotational axis with respect to the remaining holder. The opening of the bag can then be caused by the radial movement of one or both suctioning devices. The suctioning device can be embodied, for example, by one or more suction nozzles.

It can also be provided that the first and/or the second holder each comprises a bag lifter (or lifting device) for lifting a bag from a transfer position into a filling position. When an empty bag is fed to the two cooperating holders, the transfer position, where the bag is transferred to the holders, can be at a distance below the filling opening, for example, below the filling nozzle. To enable filling without loss, the empty bag has to be raised upward by the holders to the filling opening, at best beyond the filling opening. These bag lifters can be pivot arms, for example, which can then lift the actual holder, i.e., for example, the suctioning device, and lower them again. The bag lifter can be embodied as a parallelogram guide.

In the embodiment of the bag lifter as a parallelogram guide, a movement having radial component also results for the suctioning device (or another holder for holding the empty bag).

The feeder, using which an empty bag can be fed to a filling opening, can also comprise a pivot unit, using which an empty bag is pivotable from a storage position, in particular a horizontal position, into a transfer position, in particular a vertical position, for transfer to the holding unit. The pivot unit is not directly connected to the rotating filling device, but rather is arranged spatially-fixed radially outside and/or adjacent to the filling device. The pivot unit feeds the empty bags to the holding unit, this holding unit accepts them from the pivot unit. The pivot unit can therefore comprise two pivot arms, which grasp the folded empty bag at the edges and lift it from the horizontal position on a stack, which is located adjacent to the filling device, inward toward the filling device and simultaneously upward in the direction of the holding unit into a transfer position. The pivot axis is preferably arranged horizontally in this case, in particular tangentially to an imaginary circle about the axis of rotation of the filling device.

For simple fixing of the bags on the filling openings, it can be provided that the filling device has fixing units in the region of the filling openings, which are designed to hold a bag at the filling opening in the filling position after detachment of the holding unit. These fixing units can be, for example, clamps adapted to the shape of the filling opening, in particular the shape of a filling nozzle, which press the bag from the outside against the filling opening, in particular the filling nozzle. For example, one or two pairs of fixing units can be used. One pair can be used for the bag transfer and only clamps the bag centrally on the filling device, one pair has a shape adapted to the filling nozzle and encloses the filling nozzle.

To remove a filled bag from a filling opening, a bag removal unit (bag remover) which can be arranged spatially-fixed (i.e., not co-rotating on the filling device) can be provided, the gripper of which are movable, in particular pivotable, normally to the axis of rotation of the filling device, wherein the grippers are movable forward and backward along the same trajectory in the circumferential direction (in relation to the axis of rotation of the filling device). In principle, the movement normally to the axis of rotation comprises both a movement component radially to the axis of rotation and also a movement component in the circumferential direction, i.e., a movement along and/or tangentially to an imaginary circle about the axis of rotation. Due to the movement of the grippers forward in the circumferential direction, the grippers can follow the rotation of the filling device, while they grasp the bag and then pull it off and, for example, deposit it on a further conveyor unit. To be able to grasp the next bag, the grippers have to be moved backward in the circumferential direction. Subsequently, they again follow the rotation of the conveyor device, and so on.

The movement of the grippers in the circumferential direction can be predefined by a guide, such as a slotted guide, the trajectory can then be a linear or curved route, in particular a circular arc, preferably a circular arc concentric to the axis of rotation of the filling device. Or the grippers can be suspended between two pivot arms having pivot axes parallel to the axis of rotation of the filling device, to achieve a movement in the circumferential direction.

The grippers of the bag removal unit can additionally be movable or pivotable from top to bottom, to pull off a filled bag downward from the filling opening.

To compact the bulk material in the bags, a vibration plate can be provided below each filling opening, which is inclined outward viewed from the filling opening, so that filled bags rest on the vibration plate. Such a vibration plate can be used not only for the device according to the invention, but rather for any device for transporting and filling bags, preferably open bags, comprising a filling device rotatable about an axis of rotation having multiple filling openings distributed around the circumference of the filling device.

In particular, a flap pivotable toward the filling opening can be provided in an end section of the vibration plate, which is remote from the filling opening, to support a filled bag in the bottom region. This flap is used to relieve the bag material and thus causes bulging of the bag, whereby better filling and therefore lowering of the degree of filling are in turn provided. One or more impacts of the flap on the bottom of the bag as it folds up can also contribute to compacting the bulk material in the bag.

The method for transporting and filling bags, preferably open bags, using a device according to the invention presumes that the filling device having multiple filling openings distributed around the circumference of the filling device rotates at constant velocity, wherein a feeder feeds an empty bag to a filling opening, wherein the feeder comprises at least one holding unit for a bag, which is movable normally to the axis of rotation of the filling device. It is provided in this case that two separate holders of the holding device jointly accept an empty bag at a transfer position, the holders are each moved synchronously forward along the open trajectory, while the bag is fastened to the filling device, the holders release the bag and subsequently the holders are each moved backward, in particular synchronously, along the same open trajectory into the transfer position, to again accept an empty bag.

Synchronous movement is understood here to mean that first and second holder move at the same angular velocity and are radially aligned with one another. The forward movement should best occur synchronously, because otherwise the bag, more precisely its opening, does not have a defined position. Thus, a non-synchronous forward movement (and therefore a relative movement of, for example, the suctioning device in the circumferential direction) would also be conceivable, preferably during the short time of the bag opening, to facilitate the bag opening, for example, if the bags are electrostatically charged. The reverse movement of the holders will also generally be synchronous, since the holders have to be back in the transfer position at the same time.

BRIEF DESCRIPTION OF THE FIGURES

The invention will be explained in greater detail on the basis of an exemplary embodiment. The drawings are by way of example and are to illustrate the concept of the invention, but are in no way to restrict it or even exhaustively reproduce it.

In the figures.

DETAILED DESCRIPTION

Figure 1:
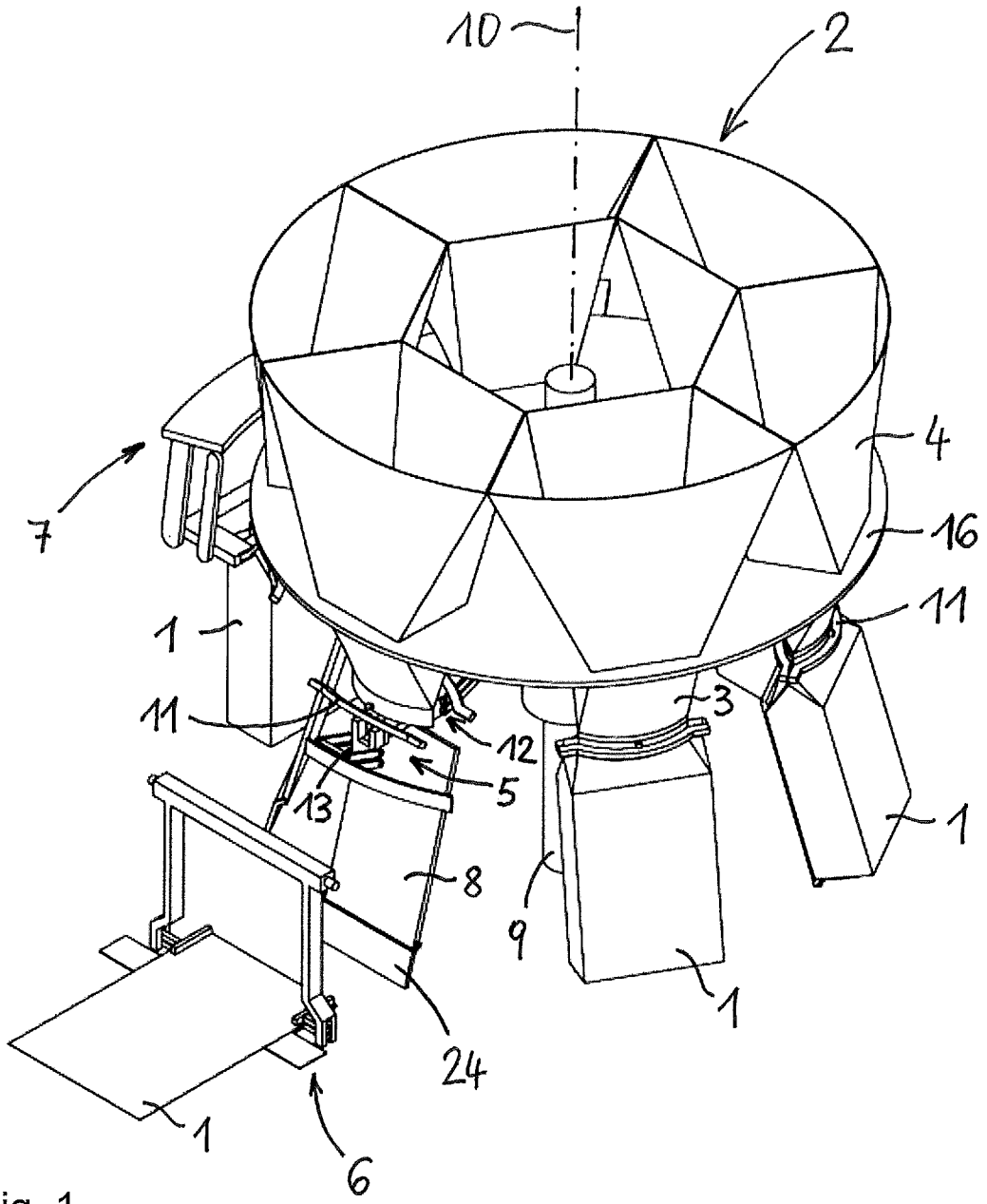
FIG. 1 shows an overview of a device according to the invention in a perspective illustration from above.

FIG. 1 shows an overview of a device according to the invention for transporting a bag 1. The device comprises a filling device 2, the filling openings of which are formed by filling nozzles 3. A filling funnel 4, to which bulk material is applied by a unit (not shown), is arranged above each filling nozzle 3. The device furthermore comprises a feeder, which is composed here of a holding unit 5 and a pivot unit 6. The device also comprises a bag removal unit (bag remover) 7 for removing a filled bag from the filling opening of the filling nozzle 3. A vibration plate 8 arranged inclined downward and outward, and on which the filled bags 1 rest, is provided below each filling opening or below each filling nozzle 3. The bulk material inside the bag 1 is compacted by the vibration of the vibration plate 8. In addition, a compaction can also be provided by a flap 24, which is arranged at the lower end of the vibration plate 8 and is pivotable toward the filling opening. In FIG. 1, the flap 24 is folded downward, it can be located, for example, in the same plane as the vibration plate 8. This flap 24 is used in the state folded upward, where it is approximately normal to the vibration plate 8, for example, in any case for relieving the bag material of the filled bag 1.

The filling device 2 has a rotating column 9, which is arranged vertically in the operating state, and which is rotatable about an axis of rotation 10. The filling device 2 rotates counterclockwise at constant velocity here. Of course, the filling device 2 can also be moved clockwise with accordingly mirrored arrangement of the device according to the invention. The bags 1 can be fixed by clamping on the filling nozzle 3 using clamps 11, which are mounted so they are movable on the filling device 2 and are adapted to the shape of the filling nozzle 3. The carrier 16, which is in the form of a circular disk here, of the filling device 2 carries the filling funnels 4 located above the carrier 16, on the one hand, and the filling nozzles 3 arranged below the carrier 16. The diameter of the carrier 16 therefore forms the largest diameter of the filling device 2 in this example.

The first holder 12, which is mounted so it is movable on the filling device 2, of the holding unit 5 is largely concealed by the filling nozzle 3 in FIG. 1. Only the second holder 13 is recognizable, which is mounted so it is movable on a spatially-fixed guide. The spatially-fixed guide 14 is designed here as a curved guide rail, and is spatially-fixed in the sense that it is not fastened on the filling device 2 and therefore does not co-rotate with the filling device 2. The guide 14 can be fastened on a housing, for example, which encloses the device according to the invention.

Figure 2:
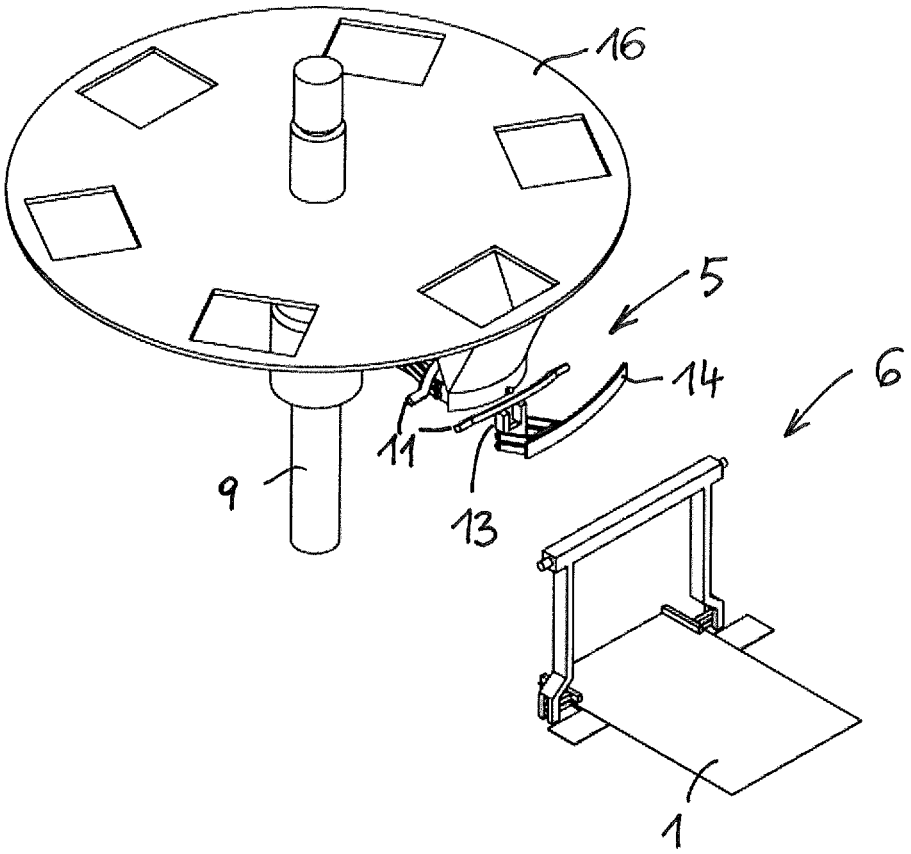
FIG. 2 shows the device during the receiving of a bag in a perspective illustration.
Figure 3:
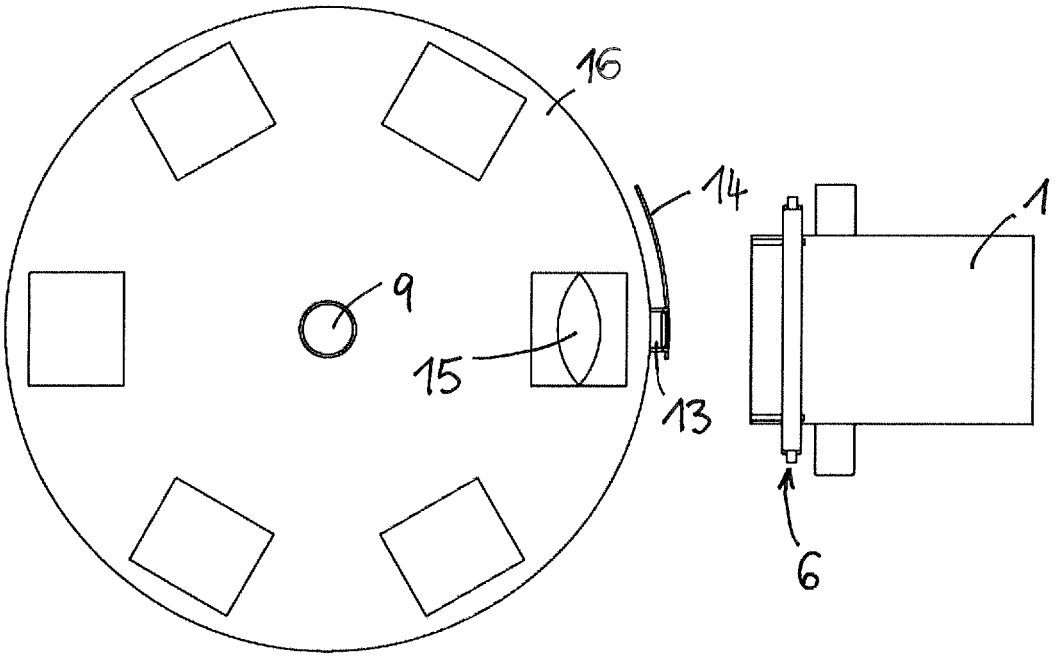
FIG. 3 shows the device during the receiving of a bag in horizontal projection.
Figure 4:
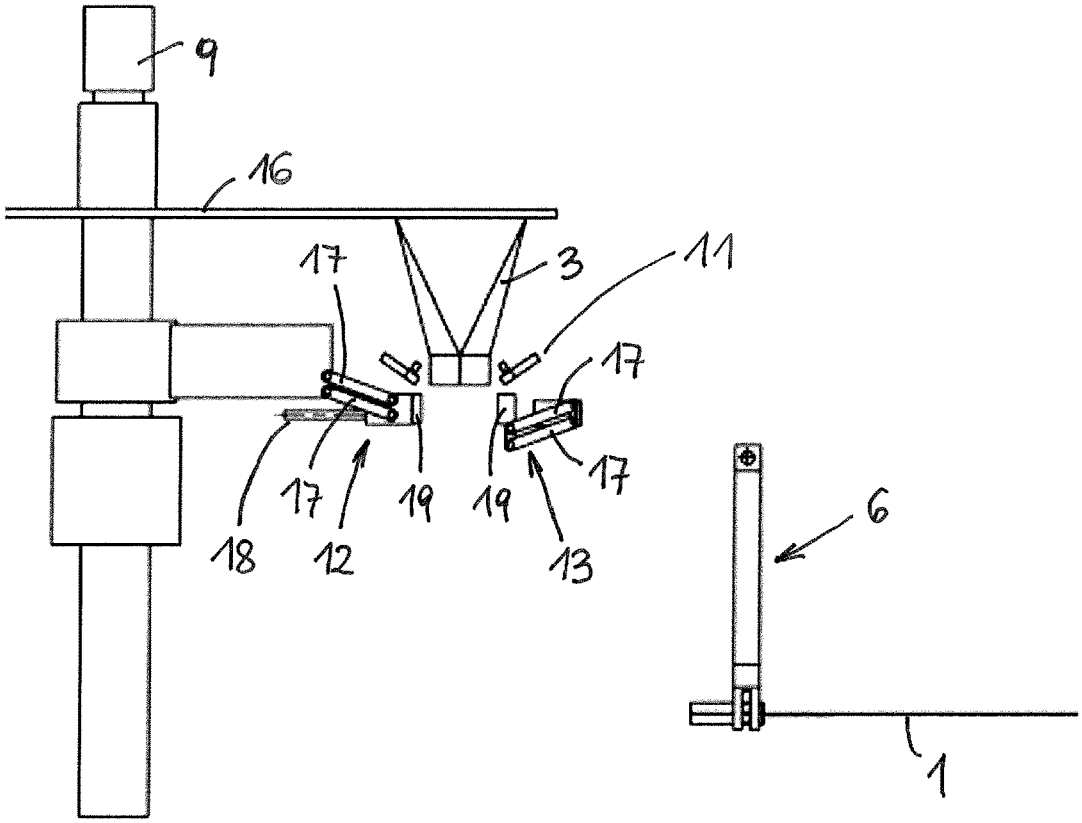
FIG. 4 shows the device during the receiving of a bag in a side view.

FIGS. 2-4 show the device according to the invention from FIG. 1 during the receiving of a bag 1 by the pivot unit 6. This pivot unit is pivotable about a pivot axis, which extends horizontally and tangentially in relation to an imaginary circle about the axis of rotation 10 of the rotating column 9. Two pivot arms are rigidly connected to one another and support grippers at the ends thereof, using which an empty bag 1 can be grasped in a horizontal storage position here.

The second holder 13 is located, viewed in the rotational direction of the filling device 2, at this time at the very beginning of the guide 14 and can already be aligned now in the radial direction with a filling opening 15. At the time of the pivot movement of the pivot unit 6, the holders 12, 13 do not necessarily have to be located at the beginning of the guide 14. The pivot unit 6 can, with vertical position of the bag 1 (see FIGS. 5-7) also wait for the returning holders 12, 13. An alignment with the filling opening also does not have to be provided, this is only required after the opening of the bag 1, namely during the placement of the bag 1.

Figure 24:
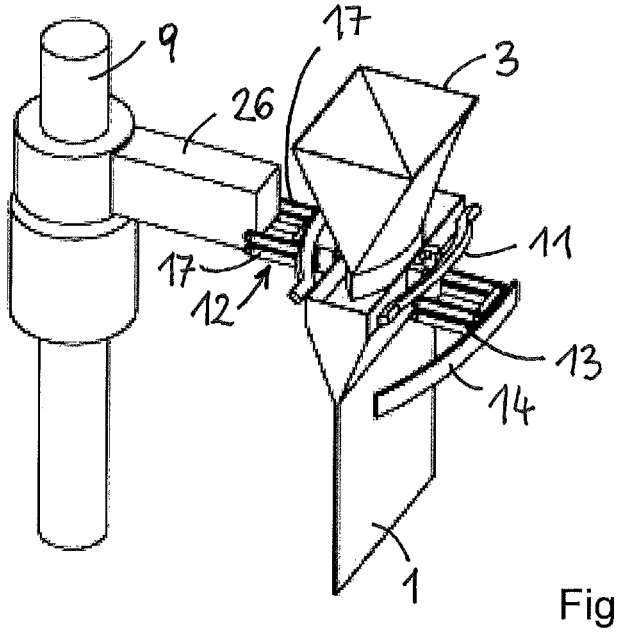
FIG. 24 shows the complete illustration of the holders according to FIG. 8.
Figure 25:
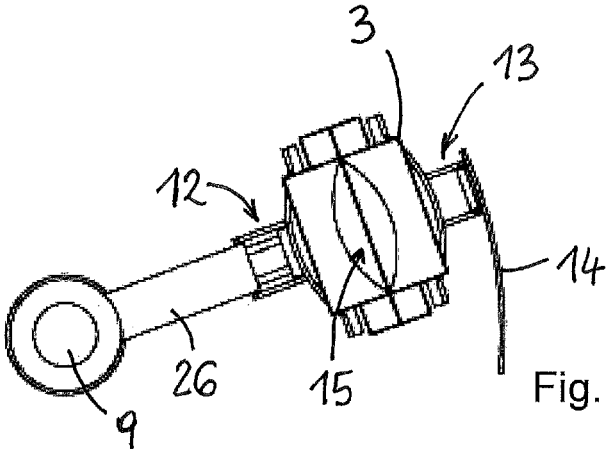
FIG. 25 shows the complete illustration of the holders according to FIG. 9.

The construction of first holder 12 and second holder 13 is recognizable in FIG. 4. To be able to recognize the details of the holders 12, 13 better, only a part of the carrier 16 to the left of the rotating column is shown. The first holder 12 has two pairs of pivot arms 17, between which a suctioning device, a suction nozzle 19 here, is held. The pivot arms 17 are linked on one side on the suction nozzle 19, and on the other side on a rotatable arm 26 (see FIGS. 24 and 25), which is mounted so it is rotatable on the rotating column 9. The first holder 12 therefore moves in space along a circular arc. The suction nozzle 19 can be raised or lowered in parallel to the axis of rotation 10 by the pivot arms 17, which are designed as a parallelogram guide. The suction nozzle 19 is additionally mounted so it is radially displaceable in relation to the pivot arms 17, by a piston 18 here. The second holder 13 also has two pairs of pivot arms 17, between which a suctioning device, a suction nozzle 19 here, is held. The pivot arms 17 are linked on one side on the suction nozzle 19, and on the other side on a guide part, which is displaceable in the guide rail of the guide 14. The pivot arms 17 also embody a parallelogram guide here. The guide rail has the form of a circular arc here, which is concentric to the axis of rotation 10. The suction nozzle 19 can be raised or lowered in parallel to the axis of rotation 10 by the pivot arms 17. The suction nozzle 19 is not mounted radially displaceable here.

The holders 12, 13 and/or the suction nozzles 19 thereof are located in the transfer position in FIGS. 2-4, where an empty bag 1 can be accepted by the pivot unit 6.

The trajectories of the holders 12, 13 are formed as circular arcs concentric to the axis of rotation 10 and therefore extend in parallel to one another. The trajectory of the first holder 12, more precisely the trajectory of the mounting of the pivot arms 17, extends inside the filling openings 15, the trajectory of the second holder 13, more precisely the trajectory defined by the guide 14, extends outside the filling openings 15. The guide 14 of the second holder 13 is arranged radially outside the carrier 16, the second holder 13 is always located partially radially inside and partially radially outside the carrier 16 and/or the largest diameter of the filling device 2.

The holders 12, 13, as will be described hereafter, are moved cyclically about the axis of rotation 10, namely always rotated one portion about the axis of rotation 10 in one direction and subsequently one portion in the other direction and then again one portion in the first direction, and so on, while the filling device 2 rotates continuously at constant velocity about the axis of rotation 10, i.e., changes neither the rotational direction nor the rotational velocity.

Figure 5:
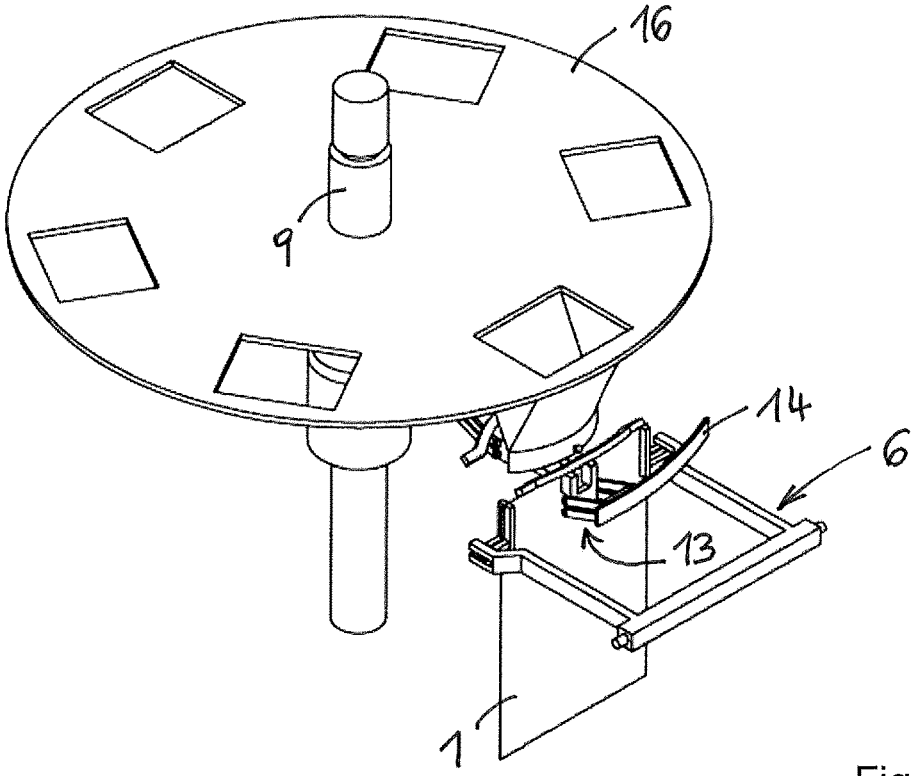
FIG. 5 shows the device after a bag is pivoted up in a perspective illustration.
Figure 6:
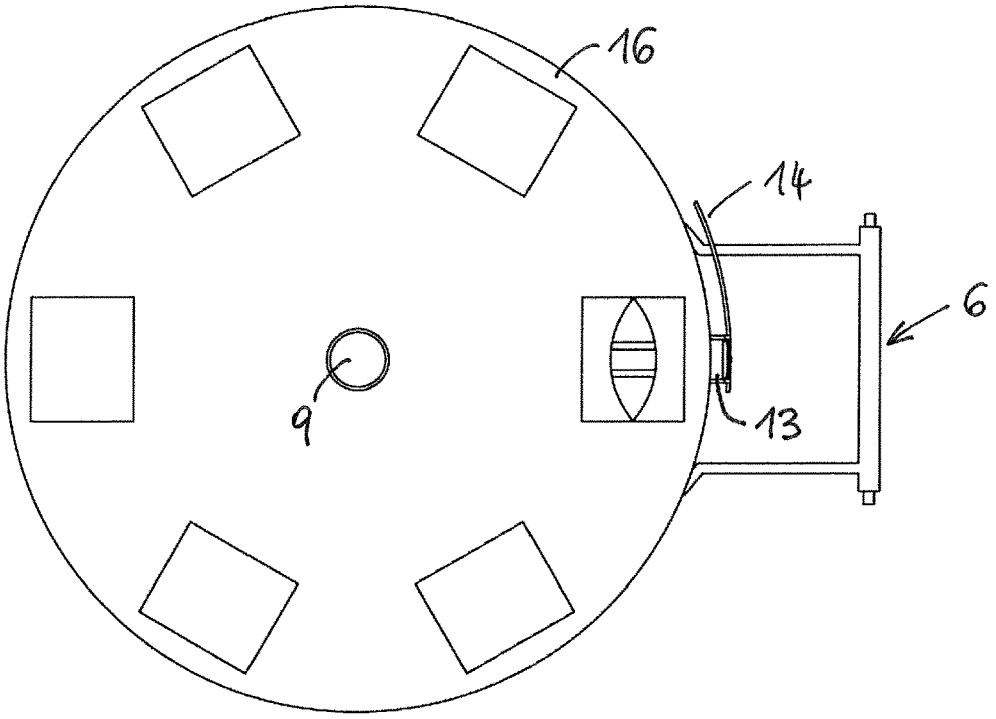
FIG. 6 shows the device after a bag is pivoted up in horizontal projection.
Figure 7:
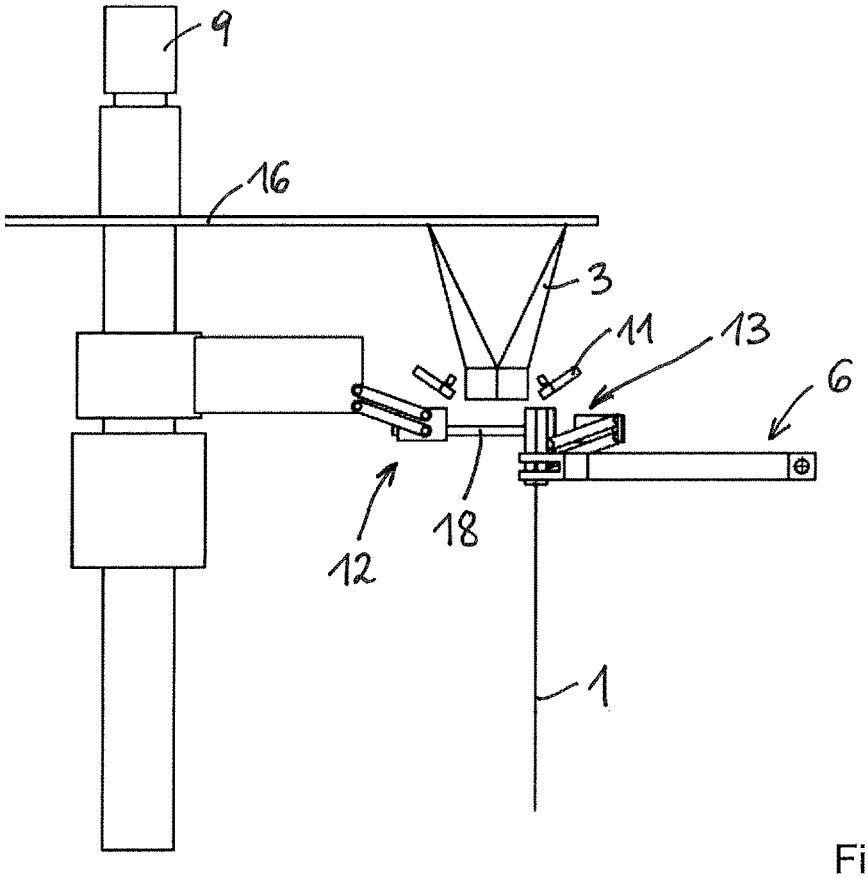
FIG. 7 shows the device after a bag is pivoted up in a side view.

FIGS. 5-7 show the device according to the invention from FIG. 1 after the pivoting up of a bag 1 by the pivot unit 6. The two pivot arms of the pivot unit 6 have pivoted the empty bag 1 from the horizontal storage position into a transfer position, which is vertical here. In this case, the pivot arms of the pivot unit 6 extend radially up to the outer end of the filling nozzle 3 in the filling device 2. The bag 1 rests with its wall facing away from the rotating column 9 against the suction nozzle 19 of the second holder 13. The piston 18 of the first holder 12, which piston 18 carries the suction nozzle 19, is displaced radially outward until this suction nozzle 19 also presses against the bag 1, specifically on its wall facing toward the rotating column 9. The bag 1 can now be held by the suction nozzles 19 and the grippers of the pivot unit 6 can be detached. The pivot unit 6 is pivoted back again and can receive the next bag 1 using the grippers.

Figure 8:
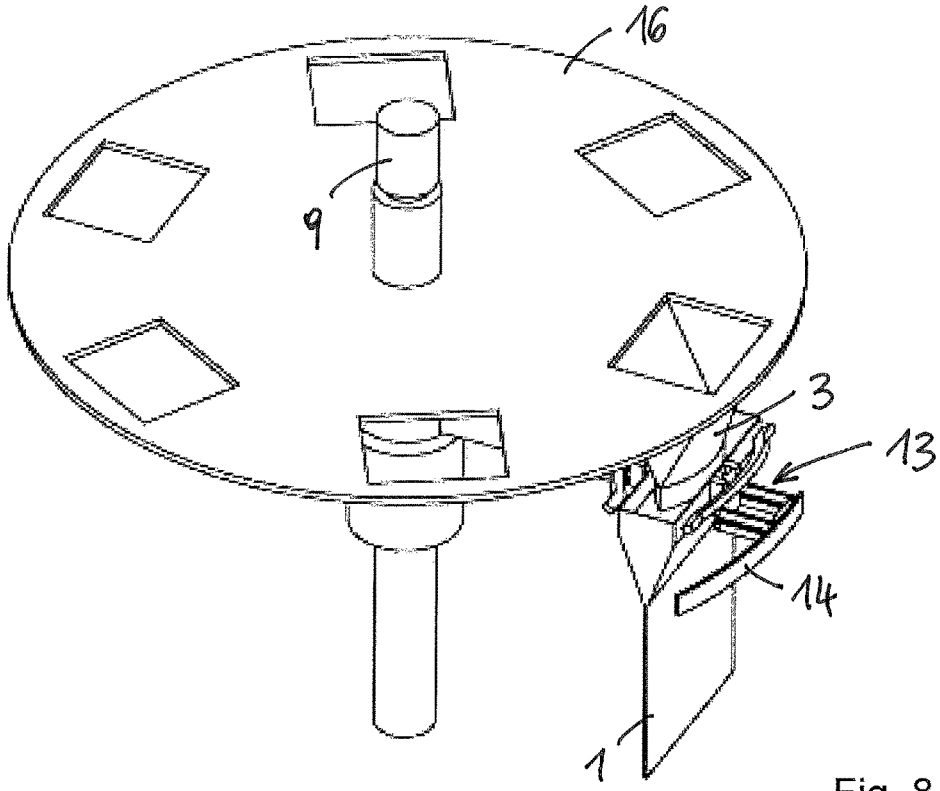
FIG. 8 shows the device during the placement of a bag onto the filling opening in a perspective illustration.
Figure 9:
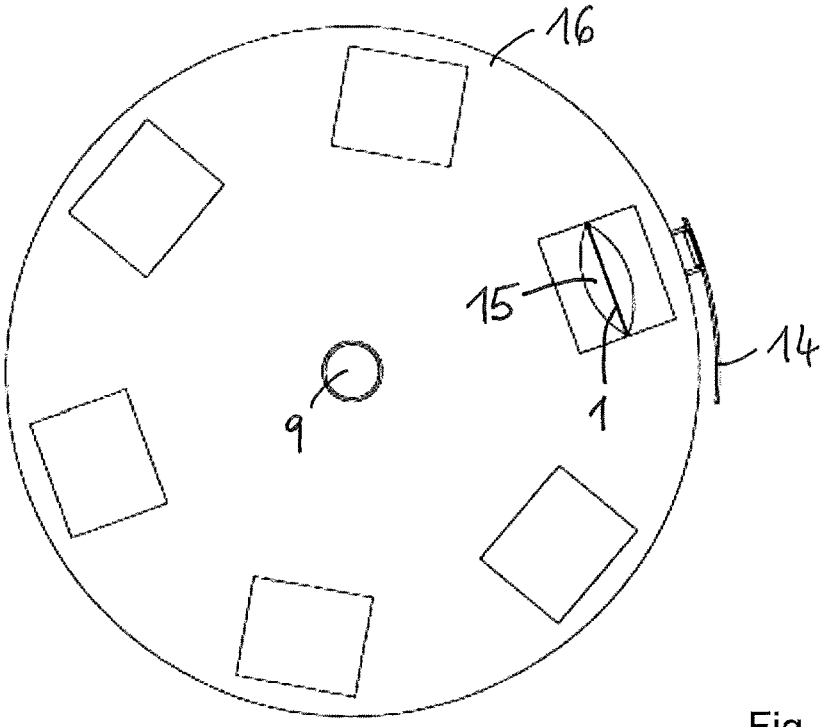
FIG. 9 shows the device during the placement of a bag onto the filling opening in horizontal projection.
Figure 10:
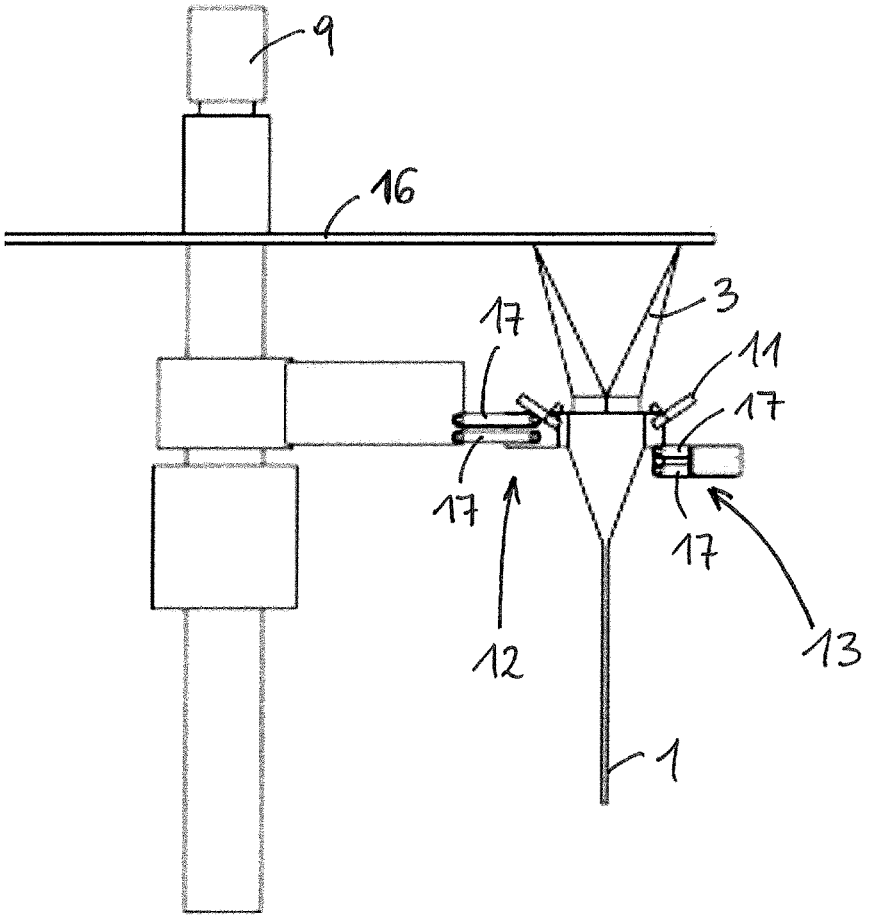
FIG. 10 shows the device during the placement of a bag on the filling opening in a side view.

FIGS. 8-10 show the device according to the invention from FIG. 1 during the placement of the bag 1 on the filling opening of the filling nozzle 3. For this purpose, firstly the bag 1 has to be opened by the holders 12, 13. This takes place here in that the piston 18 of the first holder 12 is moved radially inward again and the suctioned wall of the bag 1, which faces toward the rotating column 9, is drawn radially inward. The pivot arms 17 of the holders 12, 13 can then be raised, so that the bag is pushed from the outside onto the filling nozzle 3. The bag 1 is then pressed against the filling nozzle 3 by a pair of clamps, which only engages centrally on the filling nozzle 3, and therefore accepted from the holders 12, 13. After the pivot arms 17 have been lowered, the clamps 11 are applied to the filling nozzle 3, so that it is entirely enclosed by the clamps 11, and the bag 1 is thus fastened on the filling nozzle 3.

During these procedures—opening and placement of the bag 1—the second holder 13 moves along the guide 14 synchronously with the filling device 2, i.e., it has the same angular velocity in relation to the axis of rotation 10 of the rotating column 9 as the filling device 2. The first holder 12 is also moved synchronously with the filling device 2, i.e., it has the same angular velocity in relation to the axis of rotation 10 of the rotating column 9. Instead of the arm 26, which is rotatable about the axis of rotation 10 (see FIGS. 24 and 25), of the first holder 12, for example, by a gearwheel mounted on the rotating column 9, a rail or slotted guide could also be provided fixed on the filling device 2, for example, on the carrier 16. The first holder 12 could then remain fixed in relation to the filling device during the opening and placement of the bag 1 and only thereafter be moved back again opposite to the rotational direction along, for example, the rail or slotted guide, to receive the next bag 1.

The first holder 12 is moved back again, after the fastening of the bag 1 by the clamps 1 on the filling nozzle 3, by a rotational movement of the arm 26 into the transfer position according to FIGS. 2-7. The second holder 13 is moved back again, after the fastening of the bag 1 by the clamps 1 on the filling nozzle 3, along the guide 14 into the transfer position according to FIGS. 2-7.

Figure 11:
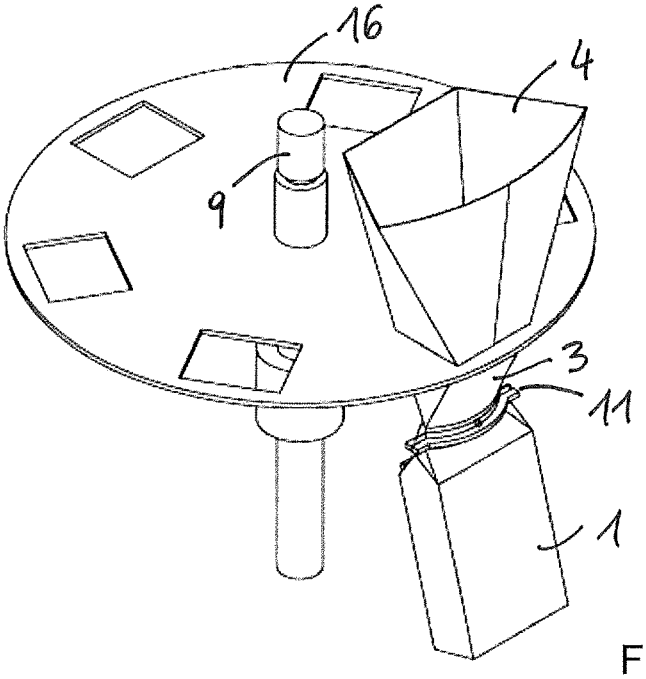
FIG. 11 shows the device during the filling of a bag in a perspective illustration.
Figure 12:
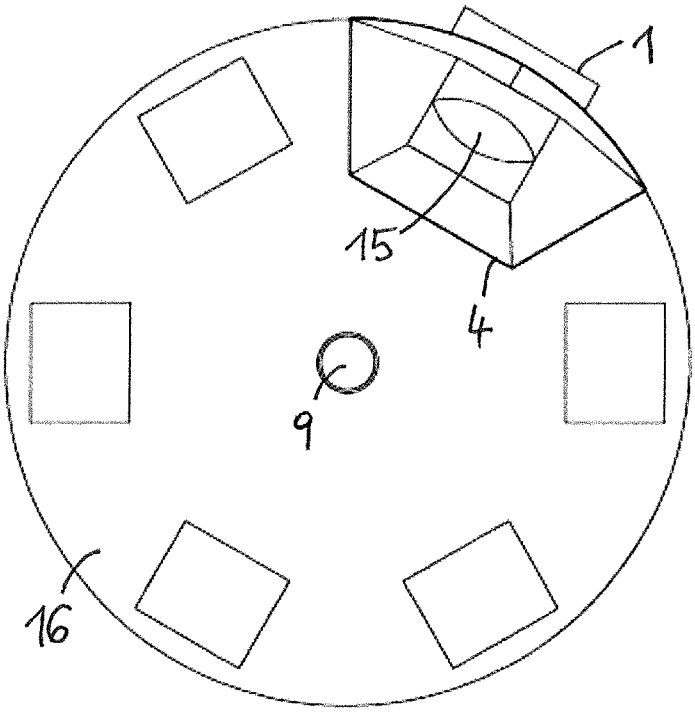
FIG. 12 shows the device during the filling of a bag in horizontal projection.
Figure 13:
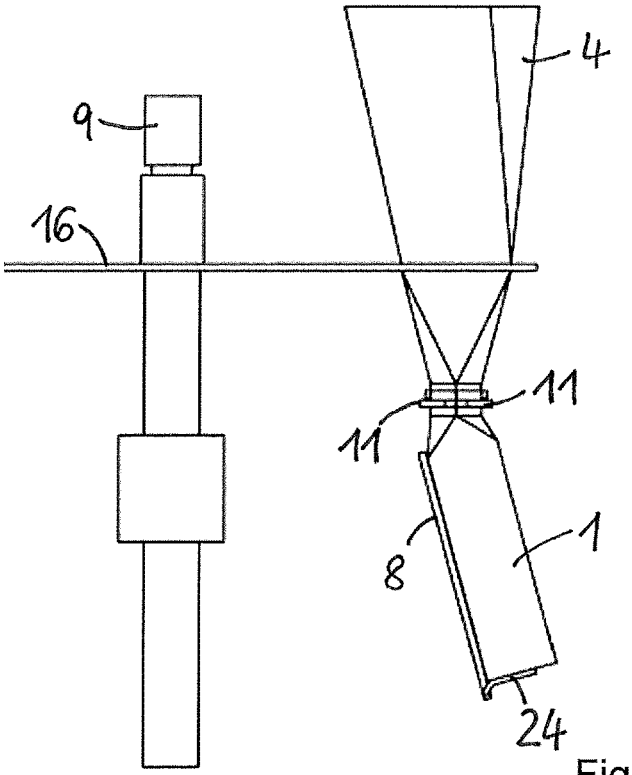
FIG. 13 shows the device during the filling of a bag in a side view.

FIGS. 11-13 show the device according to the invention from FIG. 1 during the filling of a bag 1. The holders 12, 13 were omitted in these illustrations. The clamps 11, which fix the bag 1 on the filling nozzle 3, can thus be recognized better. Bulk material is now poured into the filling funnel 4, in particular in a quantity predetermined by measurement, such as weighing, and moves through the filling nozzle 3 into the bag 1. The bag 1 now rests on the inclined vibration plate 8, whereby the bulk material is compacted in the bag 1. At the lower end of the vibration plate 8, a flap 24 is provided here, to support the filled bag 1 in the bottom region. The flap 24 is located in the state folded upward.

Figure 14:
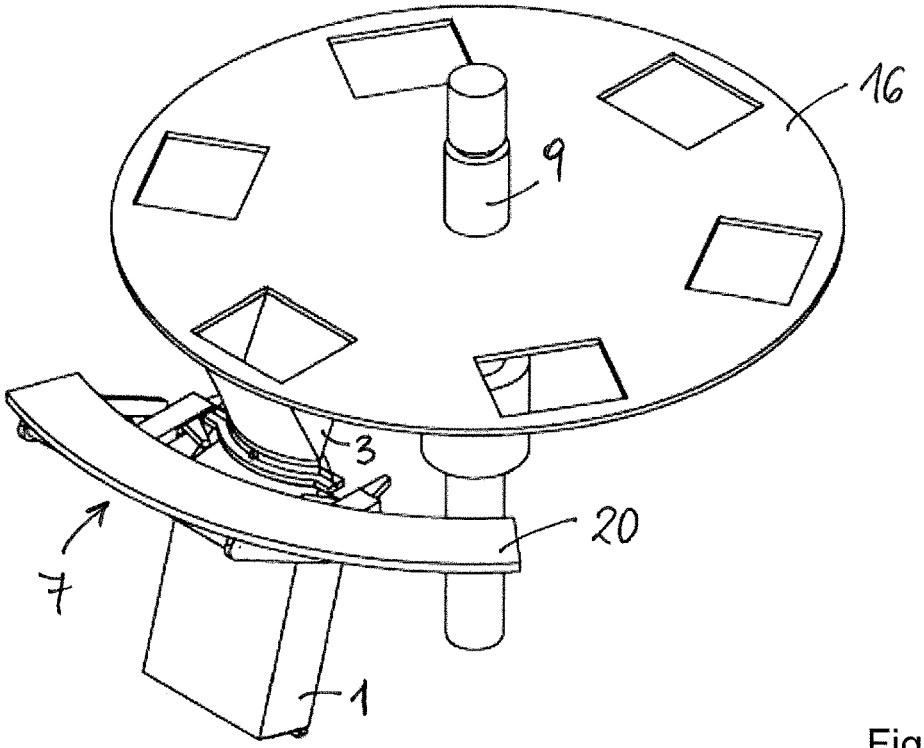
FIG. 14 shows the device during the retraction of the bag removal unit in a perspective illustration.
Figure 15:
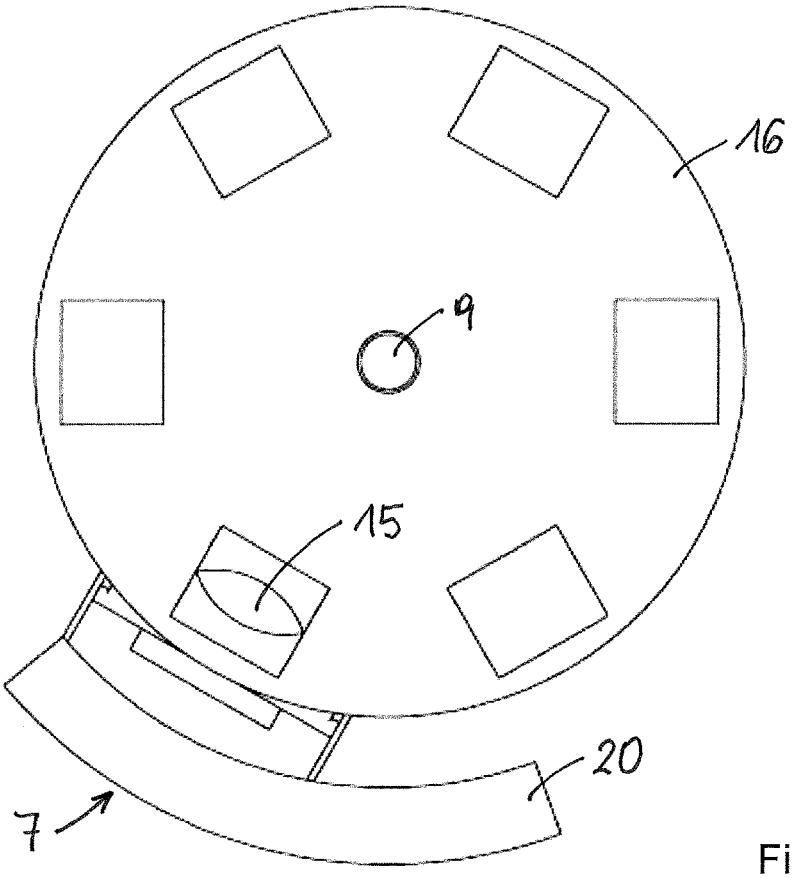
FIG. 15 shows the device during the retraction of the bag removal unit in horizontal projection.
Figure 16:
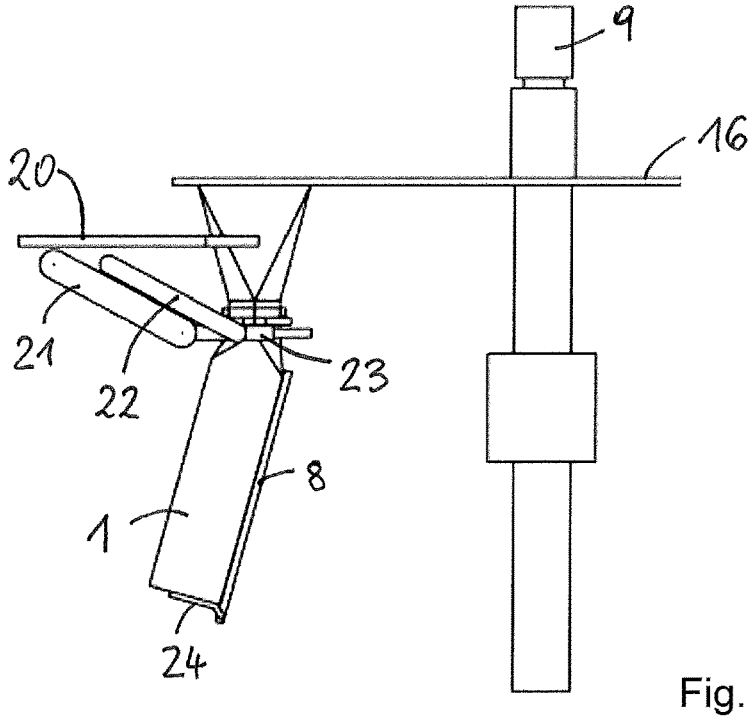
FIG. 16 shows the device during the retraction of the bag removal unit in a side view.

FIGS. 14-16 show the device according to the invention from FIG. 1 during the retraction of the bag removal unit 7 in the direction toward the filling device 2. As soon the bags 1 are completely filled and the bulk material is compacted, the bag 1 can be removed from the filling device 2. For this purpose, the corresponding grippers 23 of the bag removal unit 7 should also move along with the filling device 2. For this purpose, a spatially-fixed guide 20 is provided, which is in the form of a circular arc and is concentric to the axis of rotation 10 in this embodiment variant, so that the grippers 23 can be moved along a circular arc with the filling device 2. To be able to remove the filled bag downward and outward from the filling nozzle 3, the grippers 23 are mounted on two pairs of arms 21, 22 which are pivotable—in relation to the guide 20 and the grippers 23—while embodying a parallelogram guide.

In FIGS. 14-16, the grippers 23—viewed in the rotational direction of the filling device 2—are located at the beginning of the circular arc defined by the guide 20. The grippers 23 are now pivoted inward and upward into the filling device 2, so that the grippers 23 can grasp the bag 1. The grippers 23 are also moved in this case along the guide 20 at the same velocity with the filling device 2.

Figure 17:
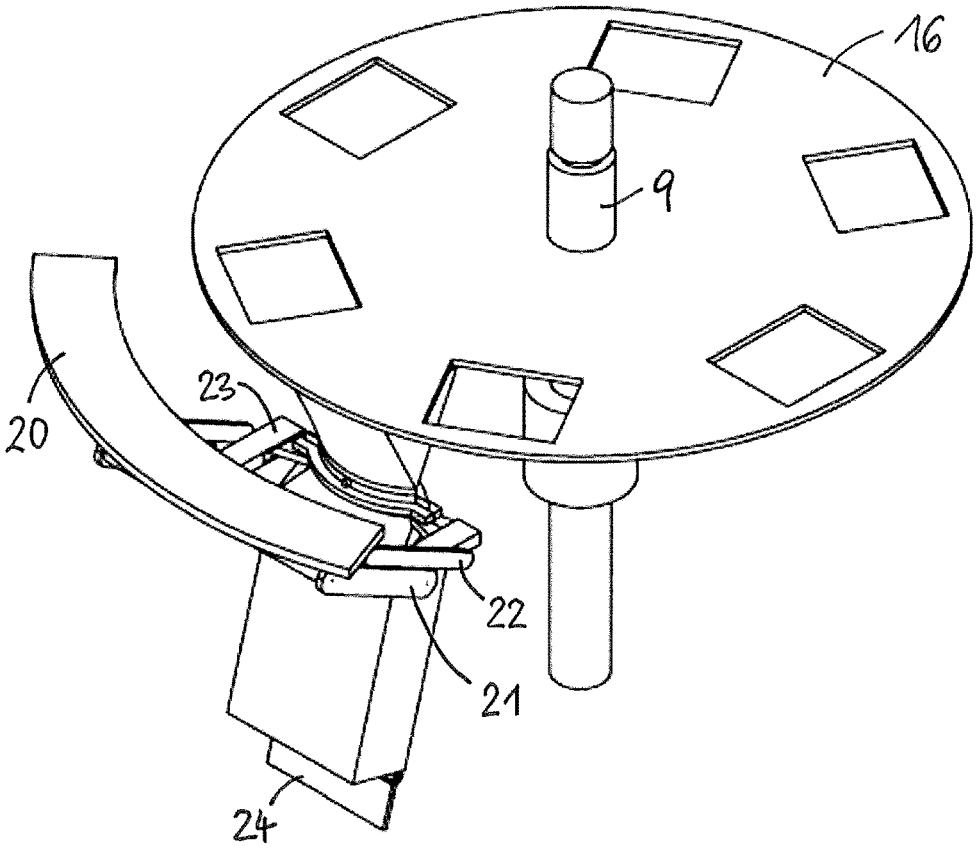
FIG. 17 shows the device before the pulling off of the filled bag in a perspective illustration.
Figure 18:
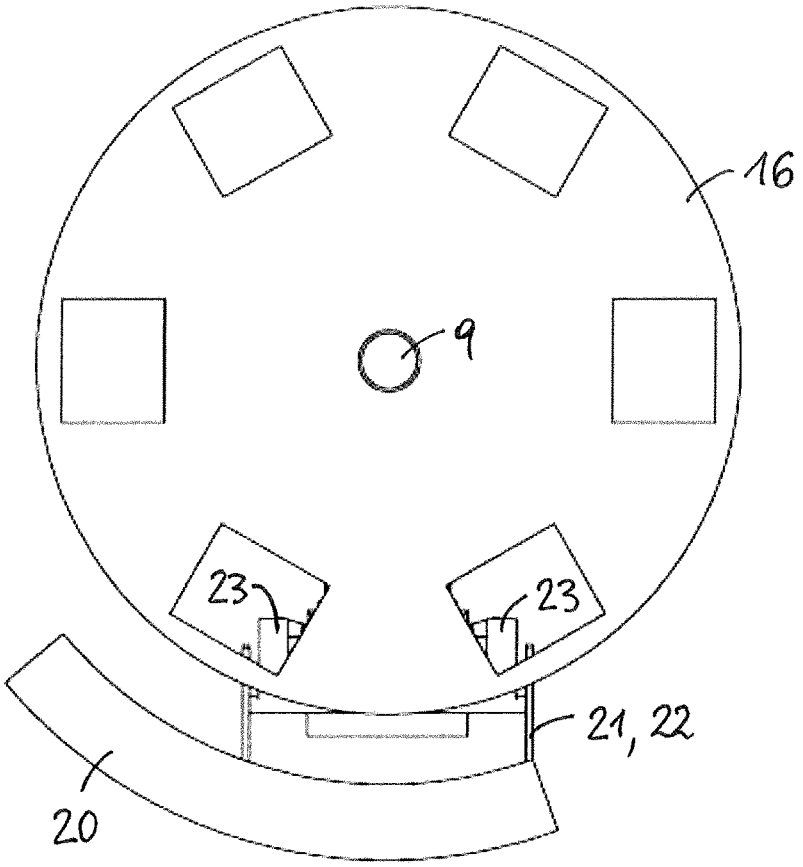
FIG. 18 shows the device before the pulling off of the filled bag in horizontal projection.
Figure 19:
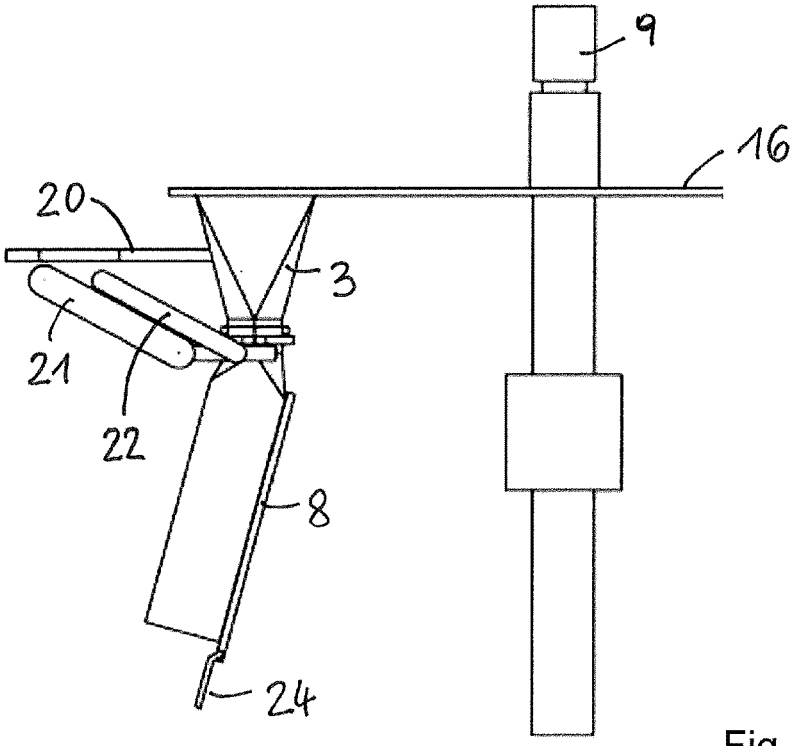
FIG. 19 shows the device before the pulling off of the filled bag in a side view.

FIGS. 17-19 show the device according to the invention from FIG. 1 before the withdrawal of the filled bag 1 from the filling device 2 by the bag removal unit 7. The flap 24 is already folded downward here. The grippers 23 have grasped the bag 1 until the grippers 23 have reached the end of the guide 20. After the grippers 23 have grasped the bag, the clamps 11 open and the bag 1 is deposited. The arms 21, 22 pivot outward and downward already simultaneously thereto or also only thereafter.

Figure 20:
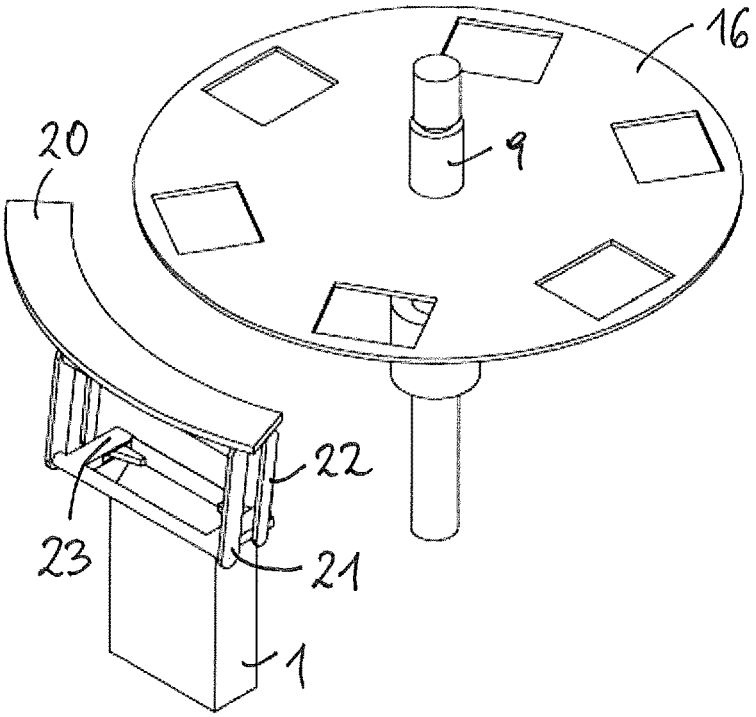
FIG. 20 shows the device after the pivoting back of the bag removal unit in a perspective illustration.
Figure 21:
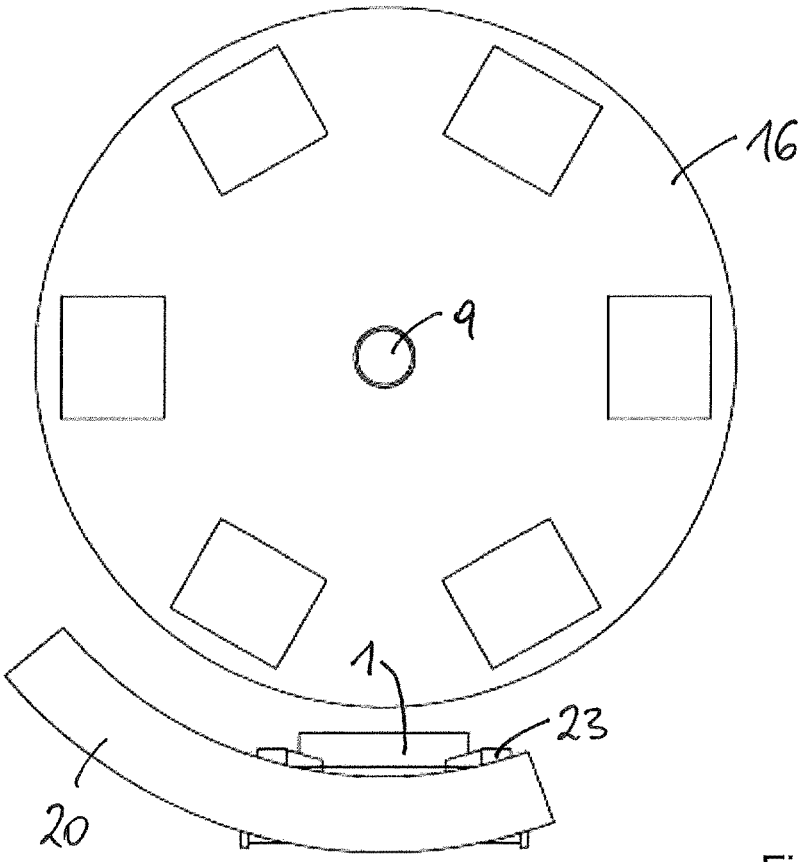
FIG. 21 shows the device after the pivoting back of the bag removal unit in horizontal projection.
Figure 22:
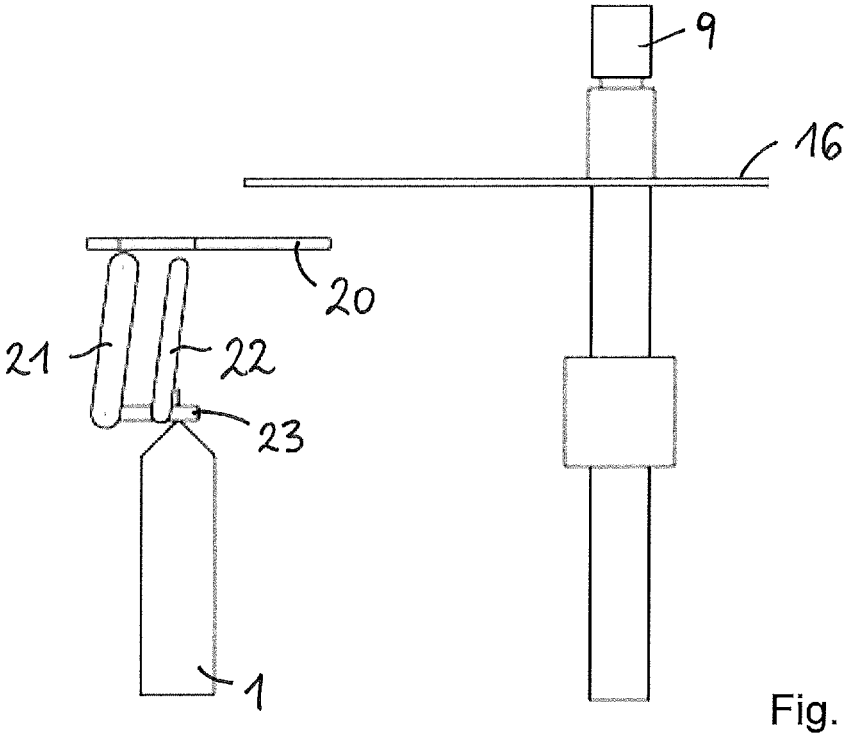
FIG. 22 shows the device after the pivoting back of the bag removal unit in a side view.

FIGS. 20-22 show the device according to the invention from FIG. 1 after the pivoting back of the bag removal unit 7 away from the filling device 2. The bag 1 is still held by the grippers 23 and can be put down, for example, on a conveyor belt arranged below the bag removal unit 7 by detaching the grippers 23 and can be transported away. Before and while the bag 1 is put down, it is spread in the header of the bag 1 by the grippers 23 for an orderly transfer.

Figure 23:
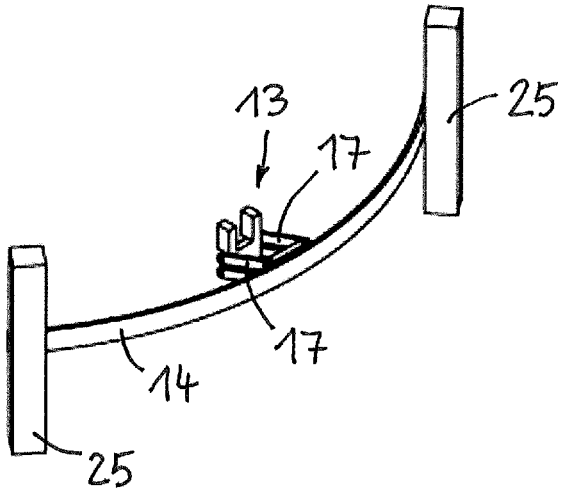
FIG. 23 shows the device having installed guide of the second holder in a perspective illustration.

FIG. 23 shows an example of how the spatially-fixed guide 14 of the second holder 13 can be embodied. In this case, the longitudinal ends of the guide rail of the guide 14 are mounted on spatially-fixed uprights 25. These uprights 25 do not have to be provided separately for the guide 14, existing uprights 25 can be used, which are part of a housing, for example, which encloses the device according to the invention.

LIST OF REFERENCE NUMERALS

1 bag
2 filling device
3 filling nozzle
4 filling funnel
5 holding unit (holder)
6 pivot unit
7 bag removal unit (bag remover)
8 vibration plate
9 rotating column
10 axis of rotation
11 clamp
12 first holder
13 second holder
14 guide for the second holder 13
15 filling opening
16 carrier
17 pivot arms
18 piston
19 suction nozzle (suctioning device)
20 guide for the bag removal unit 7
21 arm
22 arm
23 gripper
24 flap
25 upright
26 rotatable arm

The invention claimed is:

1. A device for transporting and filling bags, comprising:

a filling device, which is rotatable about an axis of rotation, having a circumference and multiple filling openings distributed over the circumference; and a feeder, which is configured to feed an empty bag to one of the multiple filling openings, comprising at least one holding unit, which is movable normal to the axis of rotation, wherein the holding unit has separate first and second holders, which are each movable forward and backward along a same open trajectory, wherein the first holder is mounted to be movable on the filling device and the second holder is mounted to be movable on a spatially-fixed guide, wherein the open trajectory of the first and the second holder is a section of a circular path, and wherein the empty bag is an unopened, folded bag and the first and second holders, which move relative to each other in a radial direction to the axis of rotation, are arranged to work together to grasp the empty folded bag from two sides and open the folded empty bag.

2. The device according to claim 1, wherein the first and second holders are movable in parallel to one another.

3. The device according to claim 1, wherein the first holder is mounted for movement radially inside the filling openings and the second holder is mounted for movement radially outside the filling openings.

4. The device according to claim 1, wherein the second holder is located at least partially radially inside a largest diameter of the circumference.

5. The device according to claim 1, wherein a center point of the section of the circular path lies on the axis of rotation.

6. The device according to claim 1, wherein at least one of the first or the second holder comprises a suctioning device.

7. The device according to claim 6, wherein the suctioning device of the at least one of the first or the second holder is movable radially in relation to the axis of rotation with respect to the remaining holder.

8. The device according to claim 1, wherein at least one of the first or the second holder comprises a bag lifter configured to lift a bag from a transfer position into a filling position.

9. The device according to claim 1, wherein the feeder comprises a pivot unit configured to pivot an empty bag from a storage position into a transfer position for transfer to the holding unit.

10. The device according to claim 1, further comprising:

a bag remover for removing a filled bag from a filling opening; and grippers that are movable normal to the axis of rotation and movable forward and backward along a same open trajectory in a direction of the circumference.

11. The device according to claim 1, wherein the bags are filled with bulk material and the device further comprises a vibration plate, which is configured for compacting the bulk material in the bags and is arranged below each filling opening, wherein, when viewed from the filling opening, the vibration plate is inclined outward so that, as they are filled, the filled bags rest on the vibration plate.

12. The device according to claim 11, wherein a flap is provided in an end section of the vibration plate remote from the filling opening, to support a filled bag in the bottom region, and wherein the flap is pivotable toward the filling opening.

13. A method for transporting and filling bags using the device according to claim 1, comprising:

rotating the filling device at constant velocity, feeding an empty bag to a filling opening, wherein the first and second separate holders jointly accept an empty bag at a transfer position, move forward synchronously along the open trajectory, while the bag is fastened on the filling device, release the bag, and subsequently move backwards along the same open trajectory into the transfer position, and wherein the open trajectory of the first and second holder is a section of a circular path.

14. The device according to claim 9, wherein the storage position is a horizontal position.

15. The device according to claim 9, wherein the transfer position is a vertical position.

16. The device according to claim 10, wherein the bag remover is arranged spatially-fixed.

17. The device according to claim 10, wherein the grippers are pivotably movable.

* * * * *